US009849894B2

(12) United States Patent
Mesher

(10) Patent No.: US 9,849,894 B2
(45) Date of Patent: Dec. 26, 2017

(54) PROTECTIVE SHROUD FOR ENVELOPING LIGHT FROM A LIGHT EMITTER FOR MAPPING OF A RAILWAY TRACK

(71) Applicant: Tetra Tech, Inc., Pasadena, CA (US)

(72) Inventor: Darel Mesher, Spruce Grove (CA)

(73) Assignee: TETRA TECH, INC., Pasadena, CA (US)

( * ) Notice: Subject to any disclaimer, the term of this patent is extended or adjusted under 35 U.S.C. 154(b) by 166 days.

(21) Appl. No.: 14/724,884

(22) Filed: May 29, 2015

(65) Prior Publication Data

US 2016/0209003 A1 Jul. 21, 2016

Related U.S. Application Data

(60) Provisional application No. 62/104,882, filed on Jan. 19, 2015.

(51) Int. Cl.

| | |
|---|---|
| ***B61K 9/00*** | (2006.01) |
| ***B61K 13/00*** | (2006.01) |
| ***B61K 9/08*** | (2006.01) |

(52) U.S. Cl.

CPC ..... *B61K 13/00* (2013.01); *B61K 9/08* (2013.01)

(58) Field of Classification Search

CPC . B61K 9/00; B61K 9/10; B61K 13/00; B61K 9/08; B61L 23/045; B61L 23/044; F21V 15/00; F21V 23/0442

USPC ..... 250/551, 239

See application file for complete search history.

(56) References Cited

U.S. PATENT DOCUMENTS

| | | | |
|---|---|---|---|
| 3,562,419 | A | 2/1971 | Stewart et al. |
| 3,942,000 | A | 3/1976 | Dieringer |
| 4,040,738 | A | 8/1977 | Wagner |
| 4,198,164 | A | 4/1980 | Cantor |
| 4,265,545 | A | 5/1981 | Slaker |
| 4,490,038 | A | 12/1984 | Theurer et al. |

(Continued)

FOREIGN PATENT DOCUMENTS

| | | |
|---|---|---|
| CA | 2732971 | 1/2016 |
| CA | 2860073 | 5/2016 |

(Continued)

OTHER PUBLICATIONS

Russia Patent and Trademark Office, Decision on Grant for Application No. 2007103331 dated Oct. 22, 2009.

(Continued)

*Primary Examiner* — Que T Le
(74) *Attorney, Agent, or Firm* — Robinson IP Law, PLLC

(57) ABSTRACT

A protective shroud is provided for enveloping light radiating from a light emitter used with a sensor system for mapping of a railway track. The protective shroud includes: a rigid body having a frame and at least one opaque panel connected to the frame, the rigid body defining at least a first portion of a light radiation zone; a skirt formed of high density fibers extending from adjacent a bottom edge of the at least one opaque panel to adjacent a ground surface; at least one light emitter connected to the rigid body adjacent a top edge of the rigid body to emit light radiation into the light radiation zone; and at least one sensor connected to the rigid body adjacent the top edge of the rigid body to sense the light emitted from the at least one light emitter.

17 Claims, 6 Drawing Sheets

(56) References Cited

U.S. PATENT DOCUMENTS

| | | | | |
|---|---|---|---|---|
| 4,531,837 | A | 7/1985 | Panetti | |
| 4,554,624 | A | 11/1985 | Wickham et al. | |
| 4,600,012 | A | 7/1986 | Kohayakawa et al. | |
| 4,653,316 | A | 3/1987 | Fukuhara | |
| 4,700,223 | A | 10/1987 | Shoutaro et al. | |
| 4,731,853 | A * | 3/1988 | Hata | G06K 9/00201 348/42 |
| 4,775,238 | A | 10/1988 | Weber | |
| 4,900,153 | A | 2/1990 | Weber et al. | |
| 4,915,504 | A | 4/1990 | Thurston | |
| 4,974,168 | A | 11/1990 | Marx | |
| 5,199,176 | A | 4/1993 | Theurer et al. | |
| 5,245,855 | A | 9/1993 | Burgel et al. | |
| 5,487,341 | A | 1/1996 | Newman | |
| 5,493,499 | A | 2/1996 | Theurer et al. | |
| 5,612,538 | A | 3/1997 | Hackel et al. | |
| 5,671,679 | A | 9/1997 | Straub et al. | |
| 5,721,685 | A | 2/1998 | Holland et al. | |
| 5,757,472 | A | 5/1998 | Wangler et al. | |
| 5,791,063 | A | 8/1998 | Kesler et al. | |
| 5,793,491 | A | 8/1998 | Wangler et al. | |
| 5,808,906 | A | 9/1998 | Sanchez-Revuelta et al. | |
| 5,969,323 | A | 10/1999 | Gurevich et al. | |
| 5,970,438 | A | 10/1999 | Clark et al. | |
| 6,025,920 | A | 2/2000 | Dec | |
| 6,055,322 | A | 4/2000 | Salganicoff et al. | |
| 6,062,476 | A | 5/2000 | Stern et al. | |
| 6,064,428 | A | 5/2000 | Trosino et al. | |
| 6,069,967 | A | 5/2000 | Rozmus et al. | |
| 6,128,558 | A | 10/2000 | Kernwein | |
| 6,243,657 | B1 | 6/2001 | Tuck et al. | |
| 6,252,977 | B1 | 6/2001 | Salganicoff et al. | |
| 6,347,265 | B1 | 2/2002 | Bidaud | |
| 6,356,299 | B1 | 3/2002 | Trosino et al. | |
| 6,405,141 | B1 | 6/2002 | Carr et al. | |
| 6,600,999 | B2 | 7/2003 | Clark et al. | |
| 6,615,648 | B1 | 9/2003 | Ferguson et al. | |
| 6,647,891 | B2 | 11/2003 | Holmes et al. | |
| 6,768,959 | B2 | 7/2004 | Ignagni | |
| 6,804,621 | B1 | 10/2004 | Pedanckar | |
| 7,023,539 | B2 | 4/2006 | Kowalski | |
| 7,036,232 | B2 | 5/2006 | Casagrande | |
| 7,054,762 | B2 | 5/2006 | Pagano et al. | |
| 7,130,753 | B2 | 10/2006 | Pedanekar | |
| 7,164,476 | B2 | 1/2007 | Shima et al. | |
| 7,357,326 | B2 | 4/2008 | Hattersley et al. | |
| 7,616,329 | B2 | 11/2009 | Villar et al. | |
| 7,680,631 | B2 | 3/2010 | Selig et al. | |
| 7,755,660 | B2 | 7/2010 | Nejikovsky et al. | |
| 8,081,320 | B2 | 12/2011 | Villar et al. | |
| 8,209,145 | B2 | 6/2012 | Paglinco et al. | |
| 8,263,953 | B2 | 9/2012 | Fomenkov et al. | |
| 8,405,837 | B2 | 3/2013 | Nagle, II et al. | |
| 8,958,079 | B2 | 2/2015 | Kainer et al. | |
| 9,175,998 | B2 | 11/2015 | Turner et al. | |
| 9,187,104 | B2 | 11/2015 | Fang et al. | |
| 9,234,786 | B2 | 1/2016 | Groll et al. | |
| 9,297,787 | B2 | 3/2016 | Fisk | |
| 9,310,340 | B2 | 4/2016 | Mian et al. | |
| 9,336,683 | B2 | 5/2016 | Inomata et al. | |
| 9,346,476 | B2 | 5/2016 | Dargy et al. | |
| 9,389,205 | B2 | 7/2016 | Mian et al. | |
| 9,423,415 | B2 | 8/2016 | Nanba et al. | |
| 9,429,545 | B2 | 8/2016 | Havira et al. | |
| 9,441,956 | B2 | 9/2016 | Kainer et al. | |
| 2002/0070283 | A1 | 6/2002 | Young | |
| 2002/0093487 | A1 | 7/2002 | Rosenberg | |
| 2002/0099507 | A1 | 7/2002 | Clark et al. | |
| 2002/0150278 | A1 | 10/2002 | Wustefeld | |
| 2002/0196456 | A1 | 12/2002 | Komiya et al. | |
| 2003/0059087 | A1 | 3/2003 | Waslowski et al. | |
| 2003/0075675 | A1 | 4/2003 | Braune et al. | |
| 2003/0140509 | A1 | 7/2003 | Casagrande | |
| 2003/0164053 | A1 | 9/2003 | Ignagni | |
| 2004/0021858 | A1 | 2/2004 | Shima et al. | |
| 2004/0088891 | A1 | 5/2004 | Theurer | |
| 2004/0122569 | A1 | 6/2004 | Bidaud | |
| 2004/0189452 | A1 | 9/2004 | Li | |
| 2004/0263624 | A1 | 12/2004 | Nejikovsky | |
| 2005/0279240 | A1 | 12/2005 | Pedanekar et al. | |
| 2006/0017911 | A1 | 1/2006 | Villar et al. | |
| 2006/0171704 | A1 | 8/2006 | Bingle | |
| 2007/0136029 | A1 | 6/2007 | Selig et al. | |
| 2007/0150130 | A1 | 6/2007 | Welles | |
| 2008/0304083 | A1 | 12/2008 | Farritor et al. | |
| 2009/0273788 | A1 | 11/2009 | Nagle, II et al. | |
| 2009/0319197 | A1 | 12/2009 | Villar et al. | |
| 2010/0289891 | A1 | 11/2010 | Akiyama | |
| 2012/0026352 | A1 | 2/2012 | Natroshvilli et al. | |
| 2015/0131108 | A1 | 5/2015 | Kainer et al. | |
| 2015/0219487 | A1 | 8/2015 | Maraini | |
| 2016/0002865 | A1 | 1/2016 | English et al. | |
| 2016/0121912 | A1 | 5/2016 | Puttagunta et al. | |
| 2016/0304104 | A1 | 10/2016 | Witte et al. | |
| 2016/0305915 | A1 | 10/2016 | Witte et al. | |
| 2016/0312412 | A1 | 10/2016 | Schrunk, III | |

FOREIGN PATENT DOCUMENTS

| | | | |
|---|---|---|---|
| DE | 10040139 | A1 | 7/2002 |
| DE | 60015268 | | 3/2005 |
| DE | 102012207427 | A1 | 7/2013 |
| EP | 0274081 | A2 | 7/1988 |
| EP | 1079322 | | 2/2001 |
| EP | 1146353 | | 10/2001 |
| EP | 1158460 | | 11/2001 |
| EP | 1168269 | | 1/2002 |
| EP | 1892503 | A1 | 2/2008 |
| EP | 1964026 | B1 | 6/2012 |
| EP | 1992167 | | 5/2016 |
| EP | 3024123 | | 5/2016 |
| EP | 2806065 | | 9/2016 |
| FR | 2674809 | A1 | 10/1992 |
| GB | 2265779 | | 10/1993 |
| GB | 2378344 | | 2/2003 |
| GB | 2536746 | | 9/2016 |
| JP | 60039555 | | 3/1985 |
| JP | 06322707 | | 11/1994 |
| JP | H07146131 | | 6/1995 |
| JP | 07280532 | | 10/1995 |
| JP | H07294443 | | 11/1995 |
| JP | H07294444 | | 11/1995 |
| JP | H0924828 | | 1/1997 |
| JP | 10332324 | | 12/1998 |
| JP | 11172606 | | 6/1999 |
| JP | 2000221146 | | 8/2000 |
| JP | 2000241360 | | 9/2000 |
| JP | 2002294610 | | 10/2002 |
| JP | 2003074004 | | 3/2003 |
| JP | 2003121556 | | 4/2003 |
| JP | 2004132881 | | 4/2004 |
| JP | 4008082 | | 11/2007 |
| JP | 5283548 | | 9/2013 |
| JP | 5812595 | | 11/2015 |
| JP | 2015209205 | | 11/2015 |
| KR | 101562635 | | 10/2015 |
| RU | 2142892 | | 12/1999 |
| RU | 101851 | | 1/2011 |
| SU | 1418105 | | 8/1988 |
| WO | 2005098352 | | 10/2005 |
| WO | 2006008292 | | 1/2006 |
| WO | WO2011002534 | | 1/2011 |
| WO | 2013146502 | | 3/2013 |
| WO | 2016168576 | | 10/2016 |
| WO | 2016168623 | | 10/2016 |

OTHER PUBLICATIONS

International Searching Authority; International Search Report and Written Opinion for Application No. PCT/US2010/029076 dated May 24, 2010.

(56) References Cited

OTHER PUBLICATIONS

International Searching Authority; International Search Report and Written Opinion for Application No. PCT/US2010/023991 dated Apr. 19, 2010.
US Patent and Trademark Office, Office Action, U.S. Appl. No. 12/465,473, dated Oct. 5, 2011.
European Patent Office, Supplementary European Search Report issued in EP 05767776.7 dated May 2, 2011.
US Patent and Trademark Office, Office Action for U.S. Appl. No. 13/795,841 dated Sep. 17, 2014.
US Patent and Trademark Office, Final Office Action for U.S. Appl. No. 12/465,473 dated Jul. 31, 2012.
US Patent and Trademark Office, Office Action for U.S. Appl. No. 11/172,618 dated Mar. 23, 2007.
US Patent and Trademark Office, Final Office Action for U.S. Appl. No. 11/172,618 dated Oct. 5, 2007.
US Patent and Trademark Office, Office Action for U.S. Appl. No. 11/172,618 dated Aug. 5, 2008.
US Patent and Trademark Office, Final Office Action for U.S. Appl. No. 11/172,618 dated Apr. 15, 2009.
Kantor, et al., "Automatic Railway Classification Using Surface and Subsurface Measurements" Proceedings of the 3rd International Conference on Field and Service Robitics, pp. 43-48 (2001).
Magnes, Daniel L., "Non-Contact Technology for Track Speed Rail Measurements (ORIAN)" SPIE vol. 2458, pp. 45-51 (1995).
Ryabichenko, et al. "CCD Photonic System For Rail Width Measurement" SPIE vol. 3901, pp. 37-44 (1999).
United States District Court for the Eastern District of Texas Tyler Division, *Georgetown Rail Equipment Company* v. *Holland L.P.*, Defendant's Invalidity Contentions Concerning U.S. Pat. No. 7,616,329 dated Sep. 19, 2013.
United States District Court for the Eastern District of Texas Tyler Division, *Georgetown Rail Equipment Company* v. *Holland L.P.*, Defendant's Supplemental Invalidity Contentions Concerning U.S. Pat. No. 7,616,329 dated Nov. 15, 2013.
Martens, John Ph.D., P.E., CFEI, M.B.A., Electrical Engineering & Computer Science, Initial Report Regarding U.S. Pat. No. 7,616,329 dated Jul. 18, 2014.
US Patent and Trademark Office, Office Action for U.S. Appl. No. 14/724,890 dated Jul. 27, 2016.
Shawn Landers et al., "Development and Calibration of a Pavement Surface Performance Measure and Prediction Models for the British Columbia Pavement Management System" (2002).
Zheng Wu, "Hybrid Multi-Objective Optimization Models for Managing Pavement Assetts" (Jan. 25, 2008).
"Pavement Condition Index 101", OGRA's Milestones (Dec. 2009).
"Rail Radar Bringing the Track Into the Office" presentation given to CN Rail Engineering on Jan. 21, 2011.
Rail Radar, Inc. Industrial Research Assistance Program Application (IRAP) (Aug. 10, 2012).
"Rail Radar Automated Track Assessment" paper distributed at the Association of American Railways (AAR) Transportation Test Center in Oct. 2010 by Rail Radar, Inc.
US Patent and Trademark Office, Office Action for U.S. Appl. No. 14/724,925 dated Feb. 26, 2016.
Liviu Bursanescu and François Blalis, "Automated Pavement Distress Data Collection and Analysis: a 3-D Approach" (1997).

* cited by examiner

PROTECTIVE SHROUD FOR ENVELOPING LIGHT FROM A LIGHT EMITTER FOR MAPPING OF A RAILWAY TRACK

CROSS-REFERENCE(S) TO RELATED APPLICATION(S)

This application is a nonprovisional application claiming priority to U.S. Provisional Patent Application Ser. No. 62/104,882 to Darel Mesher entitled "Protective Shroud" which was filed on Jan. 19, 2015, the entirety of which is incorporated herein by reference.

FIELD

This disclosure relates to the field of safety equipment for light emitting apparatuses. More particularly, this disclosure relates to safety equipment for light emitting apparatuses used for the inspection and assessment of railway tracks and track beds.

BACKGROUND

Rail infrastructure owners are motivated to replace the time consuming and subjective process of manual crosstie (track) inspection with objective and automated processes. The goal is to improve rail safety in a climate of increasing annual rail traffic volumes and increasing regulatory reporting requirements. Objective, repeatable, and accurate track inventory and condition assessment also provide owners with the capability of implementing comprehensive asset management systems which include owner/region/environment specific track component deterioration models. Such rail specific asset management systems would yield significant economic benefits in the operation, maintenance and capital planning of rail networks.

A primary goal of such automated systems is the non-destructive high-speed assessment of railway track infrastructure. Track inspection and assessment systems currently exist including, for example, Georgetown Rail (GREX) Aurora 3D surface profile system and Ensco Rail 2D video automated track inspection systems. Such systems typically use coherent light emitting technology, such as laser radiation, to illuminate regions of the railway track and trackbed during assessment operations.

In such systems, high power laser light sources may be used. Laser line projectors may include high power (Class IV) non-visible infrared laser sources (for example; a wide fan angle) (75-90° laser with a wavelength of 808 nm and a power of 10 watts). All Class IV lasers present an extreme ocular exposure hazard when used without external eye protection. Further complicated by the non-visible nature of infrared radiation (deactivating the natural aversion reflexes such as protective pupil contraction, blink, or head turn), Class IV lasers are capable of causing severe eye damage through direct, or reflected light exposure. Reflected exposure occurs when the laser radiation is scattered from highly reflective specular (shiny) targets such as polished metal surfaces (for example in the track environment; rail heads, switches, frogs). In environments where specular reflections are possible, any potential occurrence of exposure must be removed by eliminating ocular access to the beam. Beam access can be restricted by either requiring that protective eyewear (appropriately filtered) be worn by all those with any exposure potential, or by effectively enclosing the beam.

For rail testing environments with moving surveys using Class IV lasers, the top of the rail head presents a nearly ideal continuous omnidirectional specular reflector. In addition to the rail head, other flat or otherwise smooth surfaces (plates, switches, frogs, the materials between and around the rail head near crossings in urban areas), create conditions where the Maximum Permissible Exposure (MPE) limits for ocular damage are exceeded (especially in situations where those surfaces are wet). Adding to the danger of reflected laser energy, the non-divergent nature of laser sources guarantees that any reflected coherent laser light will present an ocular danger for large distances from the reflecting surfaces.

What is needed, therefore, is a protective shroud for eliminating the light radiation exposure hazard from the high-powered light emitters used in track inspection and assessment systems.

SUMMARY

To eliminate the possibility of any inadvertent and potentially eye-damaging exposure of the public or rail personnel during surveys, a protective shroud is disclosed that fully envelops the laser radiation. The shroud ensures that there is no possibility of laser light being reflected outside of the sealed shroud envelop.

The above and other needs are met by a protective shroud for enveloping light radiating from a light emitter. The protective shroud includes: a rigid body having a frame and at least one opaque panel connected to the frame, the rigid body defining at least a first portion of a light radiation zone; a skirt formed of high density fibers extending from a bottom edge of the at least one opaque panel to a ground surface; at least one light emitter connected to the rigid body to emit light radiation into the light radiation zone; and at least one three dimensional sensor connected to the rigid body to sense the light emitted from the at least one light emitter.

In one aspect, a protective shroud for enveloping light radiating from a light emitter used with a sensor system for mapping of a railway track is provided. The protective shroud includes a rigid body having a frame and at least one opaque panel connected to the frame, the rigid body defining at least a first portion of a light radiation zone. The protective shroud also includes a resilient flexible skirt extending from adjacent a bottom edge of the at least one opaque panel to adjacent a ground surface, at least one light emitter connected to the rigid body adjacent a top edge of the rigid body to emit light radiation into the light radiation zone, and at least one sensor connected to the rigid body adjacent the top edge of the rigid body to sense the light emitted from the at least one light emitter.

In one embodiment, the skirt is formed of high density nylon fibers. In another embodiment, the rigid body is substantially trapezoidal in shape. In another embodiment, the skirt is formed of a plurality of high density fibers. In one embodiment, the at least one light emitter and at least one sensor are positioned within a sensor housing located adjacent a top edge of the rigid body.

In another aspect, a protective shroud for enveloping light radiated by a light emitter used with a sensor system for mapping of a railway track is provided, the railway track including at least a first rail and a second rail. The protective shroud includes a rigid body comprising a frame and a plurality of opaque panels connected to the frame, a resilient flexible skirt extending from a location proximate a bottom edge of the plurality of opaque panels to a location adjacent to a railway surface, a first light emitter connected adjacent a top edge of the rigid body for emitting light radiation inside the enclosure toward a first rail of a railway surface, and a first sensor connected adjacent the top edge of the rigid body for sensing light emitted from the first light emitter. The rigid body and the skirt form an enclosure for substantially preventing the escape of light from the enclosure.

In one embodiment, the protective shroud further includes a second light emitter connected adjacent a top edge of the rigid body for emitting light radiation inside the enclosure toward a second rail of a railway surface and a second sensor connected adjacent the top edge the rigid body for sensing light emitted from the second light emitter.

In another embodiment, the rigid body is substantially trapezoidal in shape. In yet another embodiment, the resilient flexible skirt is formed of a plurality of high density fibers.

In one embodiment, the first light emitter and first sensor are positioned within a first sensor housing, and wherein the second light emitter and second sensor are positioned within a second sensor housing.

In another embodiment, the rigid body is formed into a first shroud half and a substantially identical second shroud half. In yet another embodiment, each of the first shroud half and second shroud half are substantially trapezoidal in shape. In one embodiment, the first shroud half and second shroud half are joined together along a plate. In another embodiment, the first shroud half and second shroud half are joined using one or more fasteners. In yet another embodiment, when a minimum load is applied to the first shroud half the first shroud half is configured to break away from the second shroud half.

In one embodiment, the shroud is configured to be removably attached to a rail vehicle.

In yet another aspect, a protective shroud for enveloping light radiated by a light emitter used with a sensor system for mapping of a railway track is provided, the railway track including at least a first rail and a second rail. The protective shroud includes a rigid body having a frame and a plurality of opaque panels connected to the frame, a resilient flexible skirt extending from a location proximate a bottom edge of the plurality of opaque panels to a location adjacent to a railway surface, a first light emitter connected adjacent a top edge of the rigid body for emitting light radiation inside the enclosure toward a first rail of a railway surface, a first sensor connected adjacent the top edge of the rigid body for sensing light emitted from the first light emitter, a second light emitter connected adjacent a top edge of the rigid body for emitting light radiation inside the enclosure toward a second rail of a railway surface, and a second sensor connected adjacent the top edge the rigid body for sensing light emitted from the second light emitter. The rigid body and the skirt form an enclosure for substantially preventing the escape of light from the enclosure and is formed into a first shroud half and a substantially identical second shroud half.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
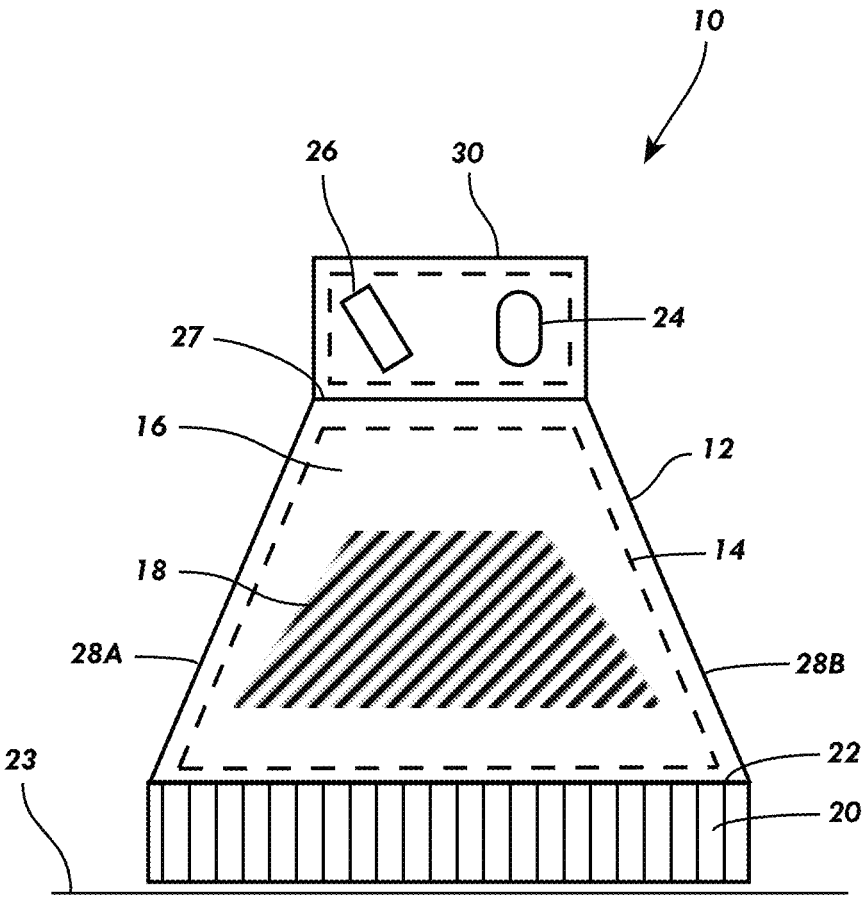
FIG. 1 shows a protective shroud according to one embodiment of the disclosure.

FIG. 1 shows an embodiment of a protective shroud 10 for enveloping light radiating from a light emission source, the protective shroud 10 including a rigid body 12 having a frame 14 and at least one opaque panel 16 connected to the frame 14, the rigid body 12 defining at least a first portion of a light radiation zone 18. The protective shroud further includes a skirt 20 including high density fibers, preferably made from a resilient and durable material such as, for example, nylon, extending from a location proximate a bottom edge 22 of the rigid body 12 to a location adjacent to a ground surface 23; at least one light emitter 24 connected to the rigid body 12 to emit light radiation into the light radiation zone 18; and at least one sensor 26 connected to the rigid body 12 to sense the light emitted from the at least one light emitter 24. The protective shroud 10 establishes a Nominal Hazard Zone for light emission sources used within the shroud 10 that substantially prevents incident or reflected light energy from escaping the light radiation zone 18.

With further reference to FIG. 1, the rigid body 12 is preferably substantially shaped as a quadrilateral such as a trapezoid, wherein the bottom edge 22 is substantially parallel to a top edge 27 of the rigid body 12. The rigid body 12 includes sloped opposing sides 28A and 28B. Opposing sides 28A and 28B preferably slope substantially outward from the top edge 27 of the rigid body 12 to the bottom edge 22 of the rigid body such that the opposing sides 28A and 28B follow a contour of the light radiation zone 18.

While the rigid body 12 is preferably shaped as a quadrilateral or trapezoid, as illustrated in FIG. 1, it is also understood that the rigid body may be formed of other various polygonal shapes such that the rigid body 12 defines the light radiation zone 18 for enveloping light emitted from one or more light emitters 24. Further, one or more sides of the rigid body 12 may be substantially curved for defining the light radiation zone 18 of the protective shroud 10.

The at least one light emitter 24 and at least one sensor 26 are preferably positioned within a sensor housing 30. The sensor housing 30 is attached to the rigid body 12 adjacent the top edge 27 of the rigid body 12. The at least one light emitter 24 and at least one sensor 26 are substantially concealed within the sensor housing 30 and oriented substantially downward towards the ground surface 23 such that the light emitter 24 projects emitted light into the rigid body 12.

Figure 2:
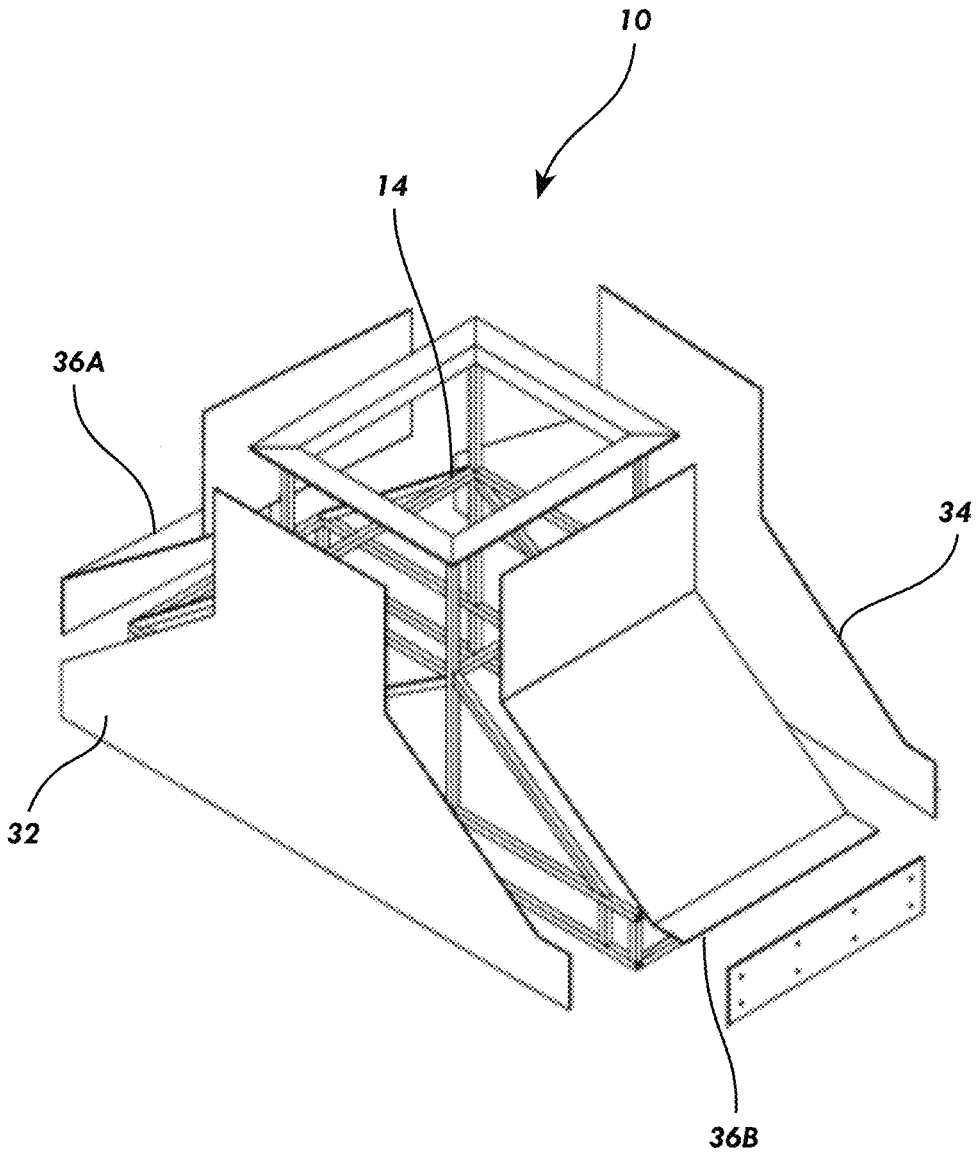
FIG. 2 shows an exploded view of a protective shroud according to one embodiment of the disclosure.

FIG. 2 shows an exploded view of one embodiment of the protective shroud 10. The rigid body 12 of the protective shroud 10 may be formed of a front panel 32, a back panel 34, and sloped side panels 36A and 36B. The front panel 32, back panel 34, and sloped side panels 36A and 36B are preferably formed of a rigid metal material, such as steel, aluminum, or an aluminum alloy. However, it is also understood that the panels may be formed of a polymer, composite, or other like opaque material.

The front panel 32, back panel 34, and sloped side panels 36A and 36B are attached to and supported by the frame 14. The frame 14 is formed of a plurality of elongate frame members which define an overall shape of the protective shroud 10. The plurality of elongate frame members forming the frame 14 are positioned adjacent the panels such that the light radiation zone 18 of the protective shroud 10 is substantially unobstructed by the frame 14. The plurality of elongate frame members may be formed of a rigid metal material, such as steel, aluminum, or an aluminum alloy, as well as other suitable materials such as a polymer or composite.

Figure 3:
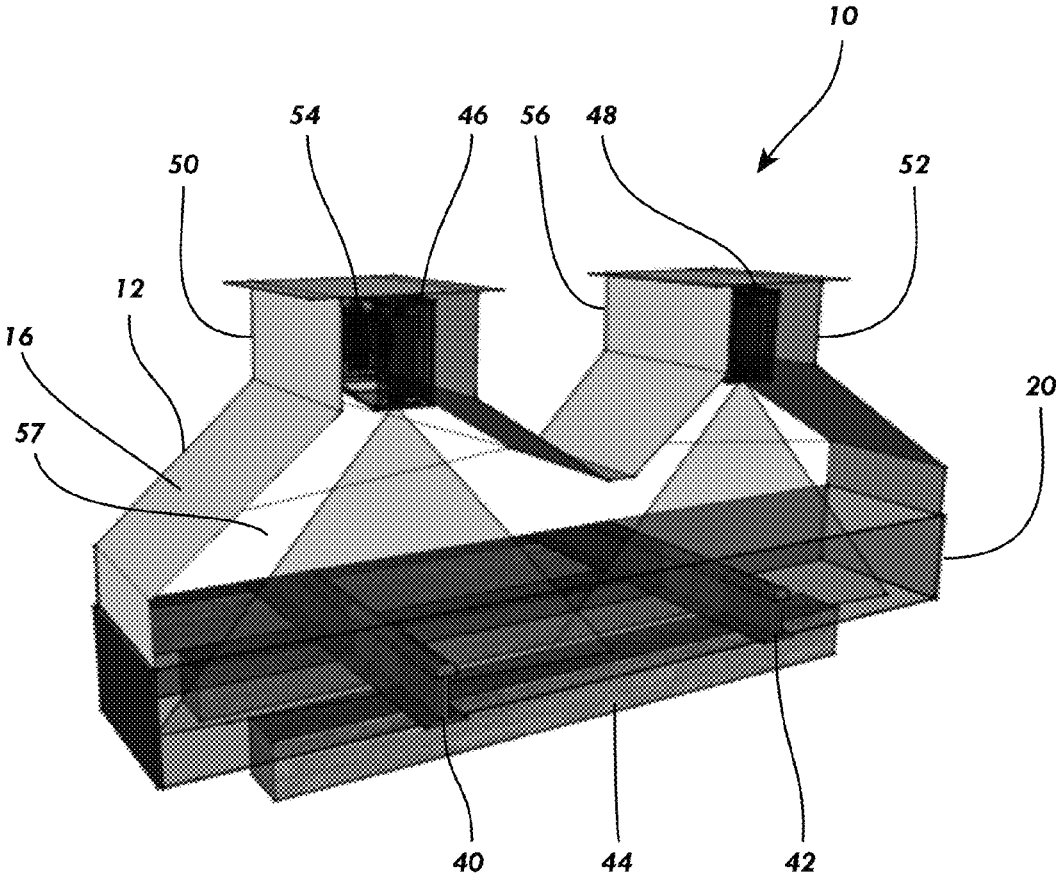
FIG. 3 shows a protective shroud for enveloping light radiated by a light emitter used with a sensor system for mapping of a railway track and track bed according to one embodiment of the disclosure.

FIG. 3 shows an embodiment of the protective shroud 10 for enveloping light radiated by a light emitter used with a sensor system for mapping of a railway track and track bed, the railway track and track bed including a first rail 40, a second rail 42, a plurality of crossties 44, and related track components. The rigid body 12 of the protective shroud 10 may be substantially formed of side-by-side trapezoids such that the rigid body 12 is substantially "M" shaped, as illustrated in FIG. 3. The protective shroud of FIG. 3 is configured to substantially envelop emitted light radiation from a first light emitter 46 and a second light emitter 48.

The rigid body 12 includes the plurality of opaque panels 16 attached to the frame 14 (not shown). While the rigid body 12 is preferably substantially "M" shaped as shown in FIG. 3, it is also understood that the rigid body 12 may be formed into an enlarged trapezoid. A first sensor housing 50 and second sensor housing 52 are attached to the rigid body 12 adjacent an upper portion of the rigid body 12 such that the first sensor housing 50 is above the first rail 40 and the second sensor housing 52 is above the second rail 42. A first sensor suite 54 may be positioned within the first sensor housing 50 and a second sensor suite 56 may be positioned within the second sensor housing 52 such that the first sensor suite 54 is substantially aligned above the first rail 40 and the second sensor suite 56 is substantially aligned above the second rail 42.

The protective shroud 10 includes the skirt 20 formed of high density fibers, preferably made from a resilient and durable material such as, for example, nylon, extending from a location proximate the bottom edge 22 of the plurality of opaque panels 16 to a location adjacent to the railway track and track bed, wherein the rigid body 12 and the skirt 20 form an enclosure 57 for substantially preventing the escape of light from the protective shroud 10. The term "substantially" as used in the context of substantially preventing the escape of light from the protective shroud 10 is intended to mean preventing light from escaping such that a Nominal Hazard Zone (defined by an interior of the protective shroud 10) is achieved.

The skirt 20 may be formed of a plurality of strands configured to extend from adjacent the bottom edge 22 of the rigid body 12 to a point adjacent the railway track and track bed. The skirt 20 is configured to deform around the railway track and track bed to substantially minimize any gaps between the skirt 20 and railway track and track bed for substantially preventing any emitted light from escaping the shroud 10 and minimizing an amount of ambient light allowed into the shroud 10. While the above description contemplates forming the skirt 20 of a plurality of high density fibers or strands, it is also understood that the skirt 20 may be formed of one or more resilient flexible panels configured to extend from the rigid body 12 to adjacent the railway track and track bed.

The first light emitter 46 connected to the rigid body 12 within the first sensor housing 50 is configured to emit light radiation inside the enclosure 58 toward the first rail 40 of the railway track and track bed. The first sensor suite 54 senses light emitted from the first light emitter 46.

The second light emitter 48 connected to the rigid body 12 within the second sensor housing 52 is configured to emit light radiation inside the enclosure 58 toward the second rail 42 of the railway track and track bed. The second sensor suite 56 senses light emitted from the second light emitter 48.

Figure 4:
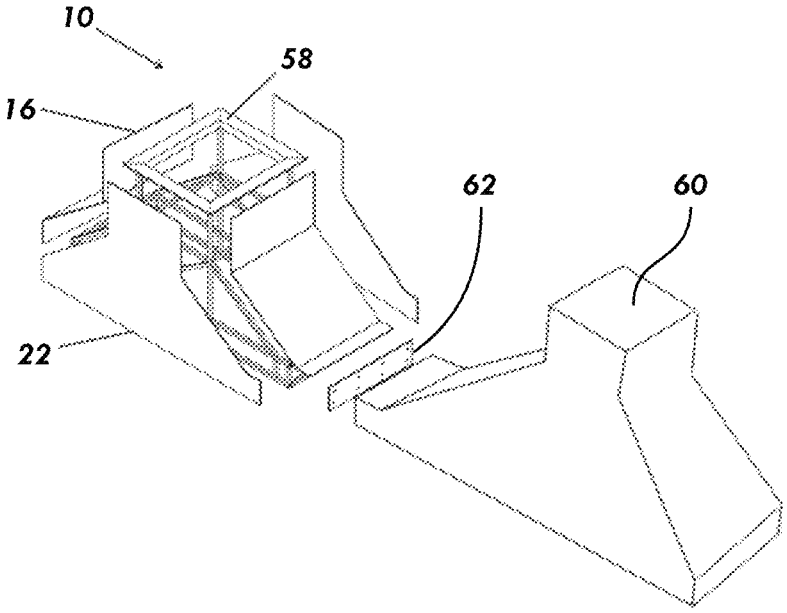
FIG. 4 shows an exploded view of a protective shroud for enveloping light radiated by a light emitter used with a sensor system for mapping of a railway track and track bed according to one embodiment of the disclosure.

Referring now to FIG. 4, when configured for use in the mapping of a railway track and track bed, the protective shroud 10 may be formed of substantially identical fastened together halves. A first shroud half 58 and second shroud half 60 are shown in FIG. 4, wherein each of the first shroud half 58 and second shroud half 60 are formed of the opaque panels 16 and frame 14 as disclosed above. The protective shroud 10 may have a length of from about 1.4 meters to about 1.8 meters along a bottom edge of the shroud 10, a width of from about 55 centimeters to about 65 centimeters, and a height of from about 80 centimeters to about 90 centimeters. The dimensions provided herein are given as examples only, and dimensions may vary depending on a particular application of the shroud 10.

The first shroud half 58 and second shroud half 60 are joined together along a plate 62. The first shroud half 58 and second shroud half 60 may be joined using a plurality of fasteners. The plurality of fasteners may have a desired strength, such that if a minimum load is placed on either the first shroud half 58 or the second shroud half 60 the fasteners will break, preventing enhanced damage to the shroud 10. Alternatively, the first shroud half 58 and second shroud half 60 may be joined by other means, such as by welding along the plate 62.

Figure 5:
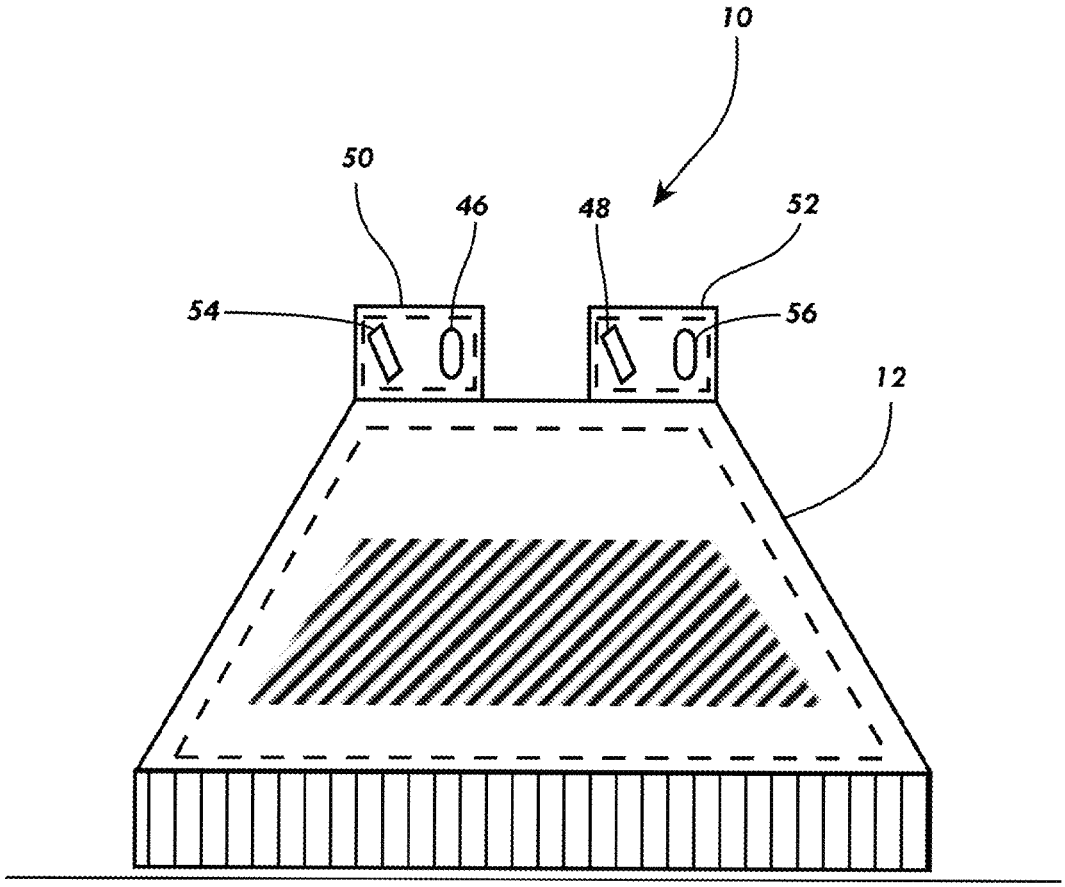
FIG. 5 illustrates a protective shroud for enveloping light radiated by a light emitter for mapping of a railway track and track bed according to one embodiment of the disclosure.

While the above description contemplates the shroud 10 being formed into the first shroud half 58 and second shroud half 60, it is also understood that the shroud 10 may be formed into a trapezoid for use in mapping a railway track and track bed, as illustrated in FIG. 5. The first sensor housing 50 and second sensor housing 52 may be located adjacent opposite ends of the top edge 27 of the rigid body 12 such that the first light emitter 46 and first sensor suite 54 are positioned above the first rail, and the second light emitter 48 and second sensor suite 56 are positioned above the second rail.

Figure 6:
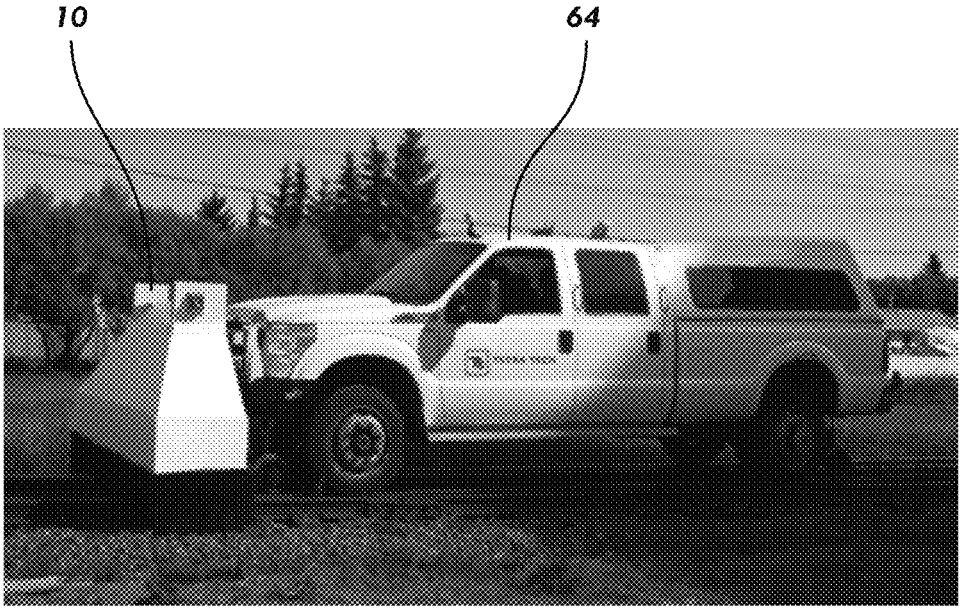
FIG. 6 shows a photo of a protective shroud mounted to a high rail vehicle.

Referring now to FIG. 6, the shroud 10 is configured to be attached to a vehicle 64, such as a road-rail or hi-rail vehicle. The shroud 10 may be either substantially permanently secured to the vehicle 64 or, alternatively, removably secured to the vehicle 64. For example, the shroud 10 may be removably attached to the vehicle 64 such that the shroud is readily installed or removed from the vehicle 64. While FIG. 6 illustrates attaching the shroud 10 to a vehicle 64 such as a road-rail or hi-rail vehicle, it is also understood that the shroud may be secured to other various rail-going vehicles, such as a locomotive, rail car, track service equipment, and other like vehicles.

The embodiments of the shroud 10 described herein are preferably used on railway track inspection and assessment systems wherein light emitted from light emitters is substantially kept within the enclosure of the protective shroud to protect the eyes of anyone in the vicinity of the apparatus. The previously described embodiments of the present disclosure have many advantages, including no negative effect on the track inspection and assessment system while providing significant safety improvements to protect nearby persons from laser radiation exposure. Another advantage is that light levels inside the enclosure are more controlled by preventing sensor interference from outside ambient sunlight. Emitted light is substantially maintained within the shroud 10 by the one or more opaque panels 16 and the skirt 20. The skirt 20, which is preferably formed of resilient flexible fibers, advantageously deforms around objects near the ground surface 23, such as the first rail 42 and second rail 44 or other objects located on a railroad track and track bed and thereby substantially prevents emitted light from escaping the shroud 10 below the bottom edge 22 of the opaque panel 16.

A further advantage of the shroud 10 is that the shroud 10 and related components are substantially modular such that the shroud 10 is easily installed, removed, or repaired. For example, as disclosed above when the shroud 10 is formed of substantially identical shroud halves, if a portion of the shroud 10 is damaged due to contact with debris or other objects located on or near the railway track and track bed, only a portion of the shroud 10 is required to be replaced, such as one of the opaque panels 16 or portions of the frame 14. Because the first shroud half 58 and second shroud half 60 may be secured such that a minimum force causes the two halves to separate, additional damage to the shroud 10 or vehicle 64 may be reduced. Additionally, the entire shroud 10 as a whole is readily attached to or removed from the vehicle 64.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A protective shroud for enveloping light radiating from a light emitter used with a sensor system for mapping of a railway track, the protective shroud comprising:

a rigid body comprising a frame and at least one opaque panel connected to the frame, the rigid body defining at least a first portion of a light radiation zone;

a resilient flexible skirt extending from adjacent a bottom edge of the at least one opaque panel to adjacent a ground surface;

at least one light emitter connected to the rigid body adjacent a top edge of the rigid body to emit light radiation into the light radiation zone; and at least one sensor connected to the rigid body adjacent the top edge of the rigid body to sense the light emitted from the at least one light emitter.

2. The protective shroud of claim 1, wherein the skirt is formed of high density nylon fibers.

3. The protective shroud of claim 1, wherein the rigid body is substantially trapezoidal in shape.

4. The protective shroud of claim 1, wherein the skirt comprises a plurality of high density fibers.

5. The protective shroud of claim 1, wherein the at least one light emitter and at least one sensor are positioned within a sensor housing located adjacent a top edge of the rigid body.

6. A protective shroud for enveloping light radiated by a light emitter used with a sensor system for mapping of a railway track, the railway track including at least a first rail and a second rail, the protective shroud comprising:

a rigid body comprising a frame and a plurality of opaque panels connected to the frame;

a resilient flexible skirt extending from a location proximate a bottom edge of the plurality of opaque panels to a location adjacent to a railway surface, wherein the rigid body and the skirt form an enclosure for substantially preventing the escape of light from the enclosure;

a first light emitter connected adjacent a top edge of the rigid body for emitting light radiation inside the enclosure toward a first rail of a railway surface; and a first sensor connected adjacent the top edge of the rigid body for sensing light emitted from the first light emitter.

7. The protective shroud of claim 6 further comprising:

a second light emitter connected adjacent a top edge of the rigid body for emitting light radiation inside the enclosure toward a second rail of a railway surface; and a second sensor connected adjacent the top edge the rigid body for sensing light emitted from the second light emitter.

8. The protective shroud of claim 6, wherein the rigid body is substantially trapezoidal in shape.

9. The protective shroud of claim 6, wherein the resilient flexible skirt comprises a plurality of high density fibers.

10. The protective shroud of claim 7, wherein the first light emitter and first sensor are positioned within a first sensor housing, and wherein the second light emitter and second sensor are positioned within a second sensor housing.

11. The protective shroud of claim 7, wherein the rigid body is formed into a first shroud half and a substantially identical second shroud half.

12. The protective shroud of claim 11, wherein each of the first shroud half and second shroud half are substantially trapezoidal in shape.

13. The protective shroud of claim 12, wherein the first shroud half and second shroud half are joined together along a plate.

14. The protective shroud of claim 13, wherein the first shroud half and second shroud half are joined using one or more fasteners.

15. The protective shroud of claim 13 wherein when a minimum load is applied to the first shroud half the first shroud half is configured to break away from the second shroud half.

16. The protective shroud of claim 6, wherein the shroud is configured to be removably attached to a rail vehicle.

17. A protective shroud for enveloping light radiated by a light emitter used with a sensor system for mapping of a railway track, the railway track including at least a first rail and a second rail, the protective shroud comprising:

a rigid body comprising a frame and a plurality of opaque panels connected to the frame;

a resilient flexible skirt extending from a location proximate a bottom edge of the plurality of opaque panels to a location adjacent to a railway surface, wherein the rigid body and the skirt form an enclosure for substantially preventing the escape of light from the enclosure;

a first light emitter connected adjacent a top edge of the rigid body for emitting light radiation inside the enclosure toward a first rail of a railway surface;

a first sensor connected adjacent the top edge of the rigid body for sensing light emitted from the first light emitter;

a second light emitter connected adjacent a top edge of the rigid body for emitting light radiation inside the enclosure toward a second rail of a railway surface; and a second sensor connected adjacent the top edge the rigid body for sensing light emitted from the second light emitter;

wherein the rigid body is formed into a first shroud half and a substantially identical second shroud half.

* * * * *